US012673799B2

(12) United States Patent
Zhang

(10) Patent No.: US 12,673,799 B2
(45) Date of Patent: Jul. 7, 2026

(54) PACKAGING BOX FOR REDUCE VOLUME AND SAFE TRANSPORTATION FOR STORAGE CERAMIC

(71) Applicant: Liling Ceramics Industry Co., Ltd., Zhuzhou (CN)

(72) Inventor: Zhiwei Zhang, Beijing (CN)

(73) Assignee: Liling Ceramics Industry Co., Ltd., Zhuzhou (CN)

( * ) Notice: Subject to any disclaimer, the term of this patent is extended or adjusted under 35 U.S.C. 154(b) by 34 days.

(21) Appl. No.: 18/810,291

(22) Filed: Aug. 20, 2024

(65) Prior Publication Data

US 2025/0178775 A1 Jun. 5, 2025

(51) Int. Cl.

| | |
|---|---|
| ***B65D 5/50*** | (2006.01) |
| ***B65D 25/10*** | (2006.01) |
| ***B65D 77/04*** | (2006.01) |

(52) U.S. Cl.

CPC ..... *B65D 5/50* (2013.01); *B65D 25/10* (2013.01); *B65D 77/0433* (2013.01)

(58) Field of Classification Search

CPC ..... B65D 5/50; B65D 25/10; B65D 77/0433; B65D 5/5028; B65D 81/05; B65D 77/0413; B65D 71/72; B65D 2577/047; B65D 5/38; B65D 5/4283

USPC .... 229/100, 122.32, 103.11, 120.01, 122.34, 229/164; 206/562, 593, 45.29, 454, 521, 206/583; 220/7, 23.89

See application file for complete search history.

(56) References Cited

U.S. PATENT DOCUMENTS

| | | | | |
|---|---|---|---|---|
| 4,394,905 | A * | 7/1983 | Hackenberg | B65D 5/5014 206/427 |
| 4,852,743 | A * | 8/1989 | Ridgeway | B65D 81/075 206/583 |
| 11,772,870 | B2 * | 10/2023 | Kronkright | B65D 81/07 206/583 |
| 2009/0302097 | A1 * | 12/2009 | Vincent | B65D 5/0254 229/120.33 |
| 2022/0002070 | A1 * | 1/2022 | Moghaddas | F25D 3/14 |

FOREIGN PATENT DOCUMENTS

| | | |
|---|---|---|
| CN | 207275397 U | 4/2018 |
| CN | 214113149 U | 9/2021 |
| CN | 219173046 U | 6/2023 |

* cited by examiner

*Primary Examiner* — Christopher R Demeree
(74) *Attorney, Agent, or Firm* — Birchwood IP

(57) ABSTRACT

The invention discloses a for reduce volume and safe transportation for Storage ceramic, comprising an outer box body, an A-type box body, a B-type box body and a packaged component, wherein the A-type box body and the B-type box body are respectively arranged inside the outer box body, and the outer box body, the A-type box body and the B-type box body are all folded from double-layer corrugated boards. thereby improving the compression resistance of the packaging box, ensuring the transportation quality of the ceramic product, having a compact structure, replacing the traditional frame structure for transportation, occupying a small space for transportation, and having a low transportation cost.

7 Claims, 5 Drawing Sheets

PACKAGING BOX FOR REDUCE VOLUME AND SAFE TRANSPORTATION FOR STORAGE CERAMIC

CROSS-REFERENCE TO RELATED APPLICATIONS

The application claims priority to Chinese patent application No. 2023233022909, field on Dec. 5, 2023, the entire contents of which are incorporated herein by reference.

TECHNICAL FIELD

This application relates to the technical field of ceramic transportation, and specifically, to a packaging box for reduce volume and safe transportation for Storage ceramic.

BACKGROUND

Because of development of the Internet, online shopping has become an irreplaceable and important part of people's lives. consumers can purchase needed items across geographical restrictions through online shopping, which has gradually become the main business of the logistics and transportation industry.

However, ceramic products are more susceptible to damage, so during logistics and transportation, external structures need to be built to support the ceramic products. Ceramic transportation takes up a lot of space and has high transportation costs.

Most of the existing logistics outer packaging is sealed on the outside with tape. The packaging shell is easily damaged during the removal of the tape, and cannot be reused, which reduces the practicality of the packaging.

As an example of this, U.S. Pat. No. 10,723,505B2 discloses an Storage and shipping box, the box includes a closing element to open and close the box as many times as needed, it provides a solution for the reuse of packaging boxes, but it requires a larger floor space and volume, and does not provide a corresponding solution for fragile items.

Therefore, it is necessary to design a packaging box that is smaller volume for convenient and safe to transport.

SUMMARY

This application provides a packaging box that addresses the ceramic transportation requires an external structure to support the ceramic products, it results in large space occupied by ceramic transportation and high transportation costs, and most packages are sealed on the outside with tape, which can easily damage the package shell during removal, making it impossible to reuse, affecting the practicality of the outer packaging.

To sum up, the packaging box in this application includes an outer box body, A-type box body, B-type box body, packaged components, support bottom plate, support column, first outer cover plate, second outer cover plate, first A-type cover plate, second A-type cover plate, first B-type cover plate, second B-type cover plate, B-type bottom plate, circular corrugated board and top ring body;

Said A-type box body and B-type box body are inside the outer box body; Said outer box body, A-type box body and B-type box body are all folded from double-layer corrugated board.

The A-type box body is symmetrically provided with a first A-type cover plate and a second A-type cover plate, and the B-type box body is symmetrically provided with a first B-type cover plate and a second B-type cover plate, the B-type box body and the A-type box body are tightly attached to each other, and the B-type box body and the A-type box body are both attached to the inner wall of the outer box body, and a B-type bottom plate is arranged inside the B-type box body, and a circular corrugated board is placed on the B-type bottom plate, and the circular corrugated board is attached to the inner wall of the B-type box body.

In prefect embodiments, said The first outer cover plate in the packaging component is adhered to the first outer bottom plate, and the packaged components consists of the first outer bottom plate, the second outer bottom plate, the external side connecting parts, the first external connecting piece, the second external connecting piece, the first A-type bottom plate, the second A-type bottom plate, the A-type side connecting parts, the first A-type connecting piece, the second A-type connecting piece, the first B-type bottom plate, the second B-type bottom plate, the B-type side connecting parts, the first B-type connecting piece and the second B-type connecting piece.

In prefect embodiments, said The first outer bottom plate is connected to the second outer bottom plate by Velcro, the second outer bottom plate is fixed to the second outer cover plate, the first outer bottom plate and the second outer bottom plate are symmetrically provided with the first outer connecting piece and the second outer connecting piece on both sides, the first outer connecting piece and the second outer connecting piece are both adhered to the external side connecting parts by Velcro, and the external side connecting parts are symmetrically fixed on both sides of the outer box body.

In prefect embodiments, said A-type side connecting parts are symmetrically arranged on both sides of the A-type box body, and the first A-type connecting piece and the second A-type connecting piece are adhered to the A-type side connecting parts by Velcro. The first A-type connecting piece and the second A-type connecting piece are symmetrically arranged on both sides of the first A-type bottom plate and the second A-type bottom plate respectively, and the first A-type bottom plate and the second A-type bottom plate are fixed on the first A-type cover plate and the second A-type cover plate respectively, and the first A-type bottom plate and the second A-type bottom plate are adhered to each other by Velcro.

In prefect embodiments, said B-type box body are symmetrically provided with B-type side connecting parts in two side, the first B-type connecting piece and the second B-type connecting piece are adhered to the B-type side connecting parts by Velcro.

In prefect embodiments, said first B-type connecting piece and the second B-type connecting piece are symmetrically arranged on the first B-type bottom plate and the second B-type bottom plate, respectively. The first B-type bottom plate and the second B-type bottom plate are fixed on the first B-type cover plate and the second B-type cover plate, respectively. The first B-type bottom plate and the second B-type bottom plate are adhered to each other by Velcro.

In prefect embodiments, said A-type supporting bottom plate is arranged at the inner bottom end of the A-type box body, and support columns are sleeved in through holes evenly arranged on the support bottom plate, and the top ends of the support columns are fixed on the side walls of the top ring body.

According to the foregoing embodiment, because the ceramic products are enclosed by using the outer box body, A-type box body and B-type box body folded by double-layer corrugated board, which improves the compression resistance of the packaging box. At the same time, the top ring body and the support bottom plate are used to limit the products in the A-type box body; the circular corrugated board is used to limit the products in the B-type box body, which ensures the transportation quality of the ceramic products. The structure is compact, replacing the traditional frame structure for transportation, and the transportation occupies a small space and has low transportation costs.

NUMBER REFERENCES

1. Outer box body;
2. A-type box body;
3. B-type box body;
4. Packaged components;
5. Support bottom plate;
6. Support column;
7. First outer cover plate;
8. Second outer cover plate;
9. First A-type cover plate;
10. Second A-type cover plate;
11. First B-type cover plate;
12. Second B-type cover plate;
13. B-type bottom plate;
14. Circular corrugated board;
15. Top ring body;
41. First outer bottom plate;
42. Second outer bottom plate;
43. External side connecting parts;
44. First external connecting piece;
45. Second external connecting piece;
46. First A-type bottom plate;
47. Second A-type bottom plate;
48. A-type side connecting parts;
49. First A-type connecting piece;
50. Second A-type connecting piece;
51. First B-type bottom plate;
52. Second B-type bottom plate;
53. B-type side connecting parts;
54. First B-type connecting piece;
55. Second B-type connecting piece;

DETAILED DESCRIPTION OF THE EMBODIMENTS

This application is further described in detail below by using specific embodiments in conjunction with the accompanying drawings. Herein, associated similar element numbers are used for similar elements in different embodiments. In the following embodiments, many details are described to facilitate better understanding of this disclosure. However, those skilled in the art may readily understand that some features may be omitted in a different case, or may be replaced by another element, material, and method. In some cases, some operations related to this application are not shown or described in this specification, this is intended to prevent excessive descriptions from dominating a core part of this application, and for those skilled in the art, it is inessential to describe these related operations in detail, and they can fully understand the related operations based on the descriptions in this specification and general technical knowledge in the art.

In addition, features, operations, or characteristics described in this specification may be combined into various embodiments in any proper manner.

Serial numbers of components such as "first", "second", and the like herein are only used to distinguish between the described objects, and do not have any sequential or technical meaning. Unless otherwise specified, a "connection" and a "communication" mentioned in this application include both direct and indirect connections (communications).

First Embodiment

Figure 1:
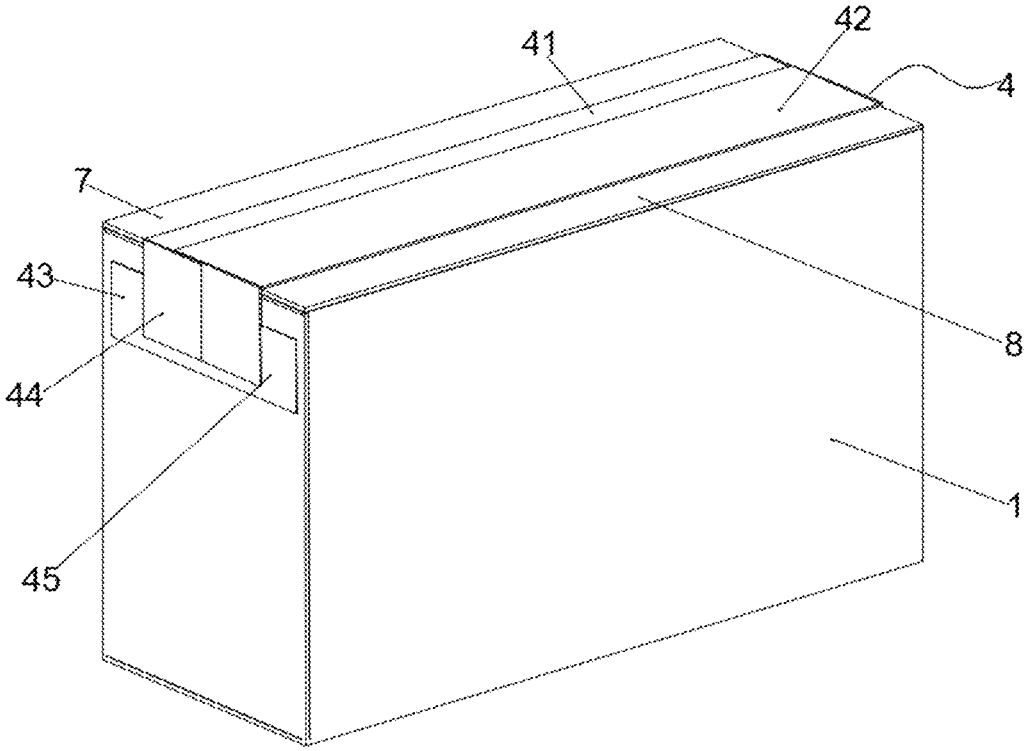
FIG. 1 is a 3D diagram of the overall structure of the packaging box.
Figure 2:
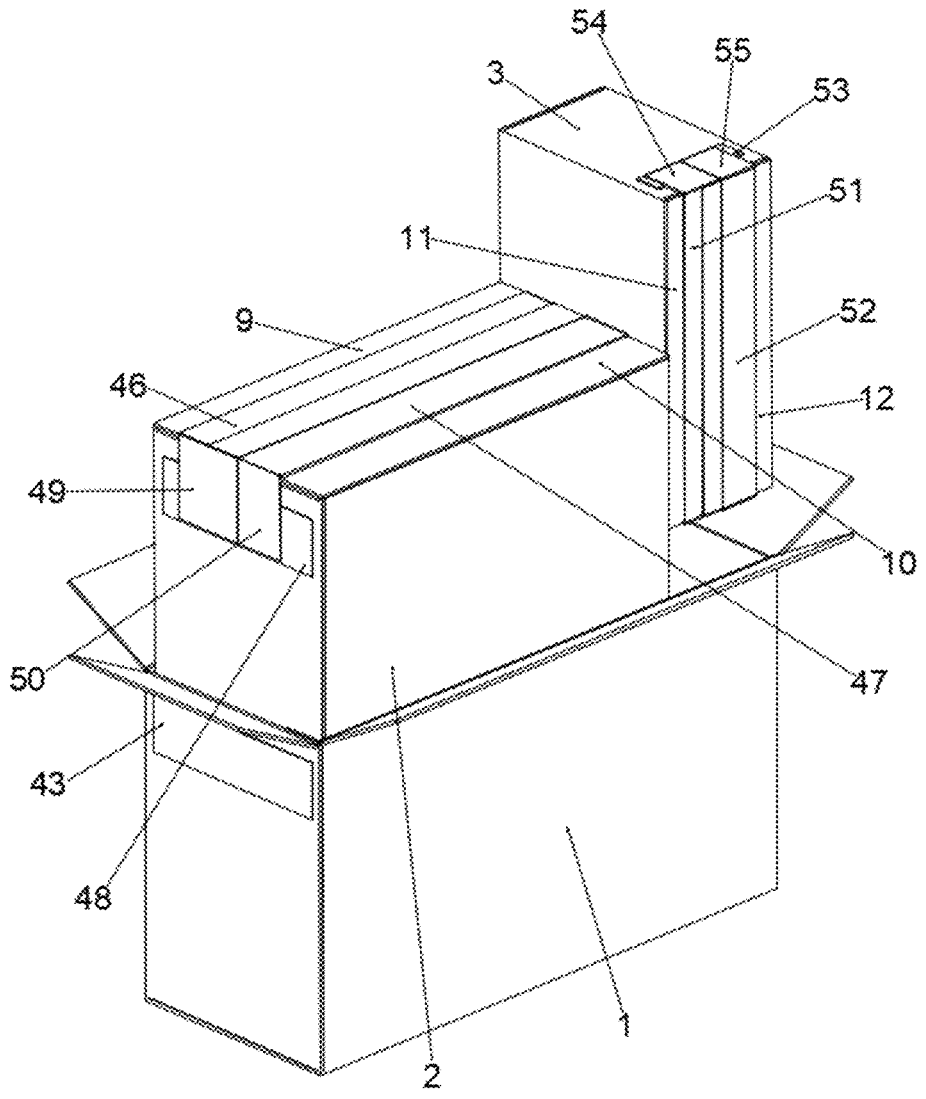
FIG. 2 is a schematic diagram of the assembly structure of the packaging box.
Figure 3:
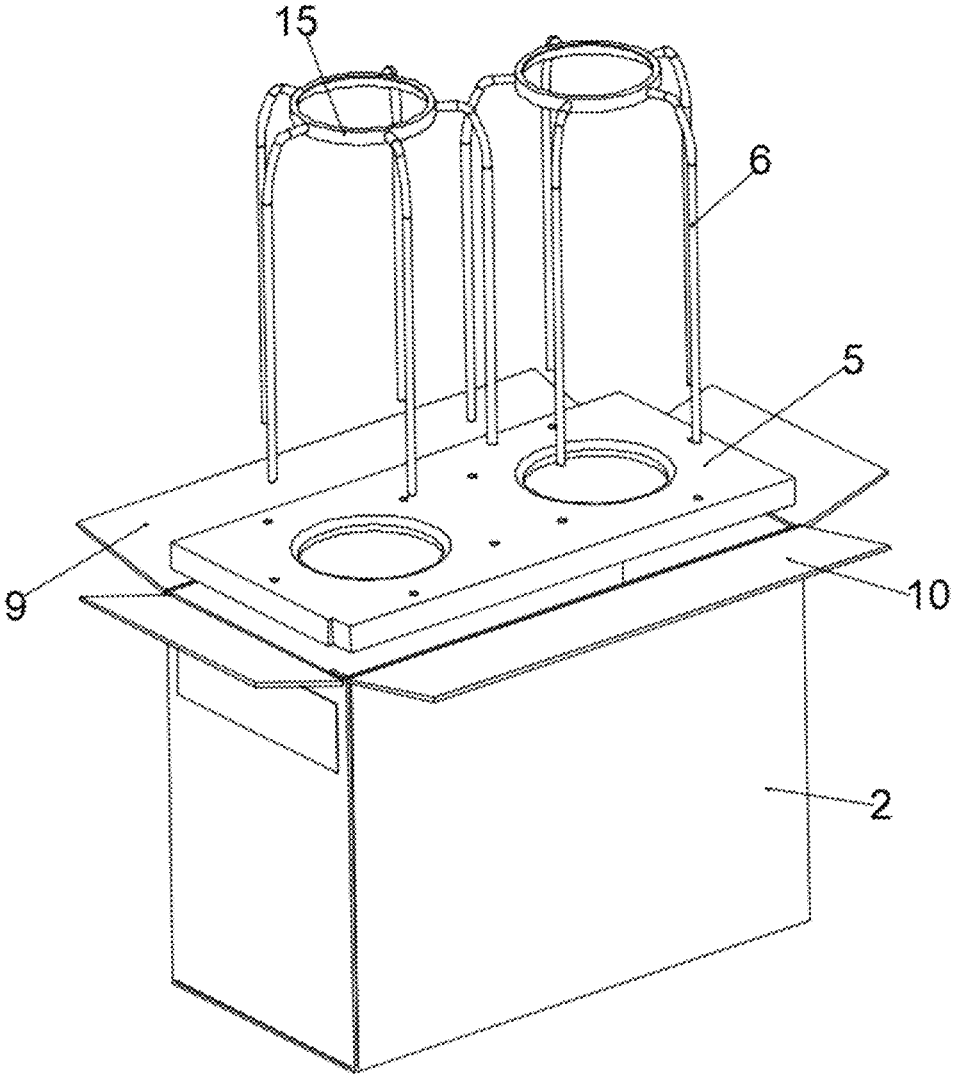
FIG. 3 is a schematic diagram of the internal structure of the A-type box body.
Figure 4:
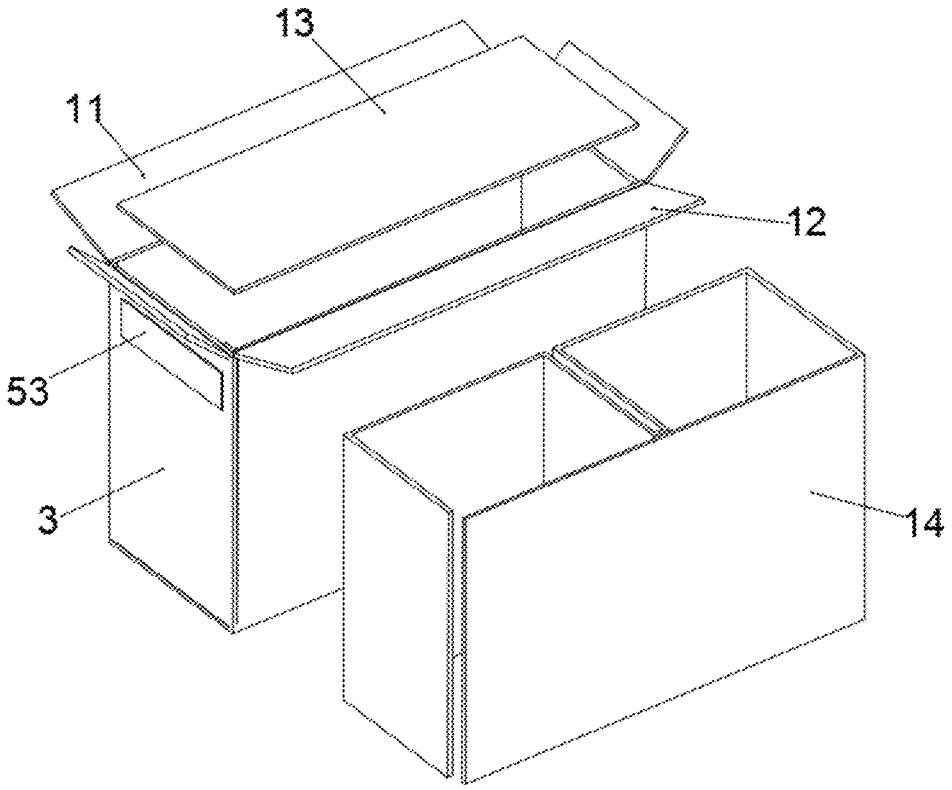
FIG. 4 is a schematic diagram of the internal structure of the B-type box body.
Figure 5:
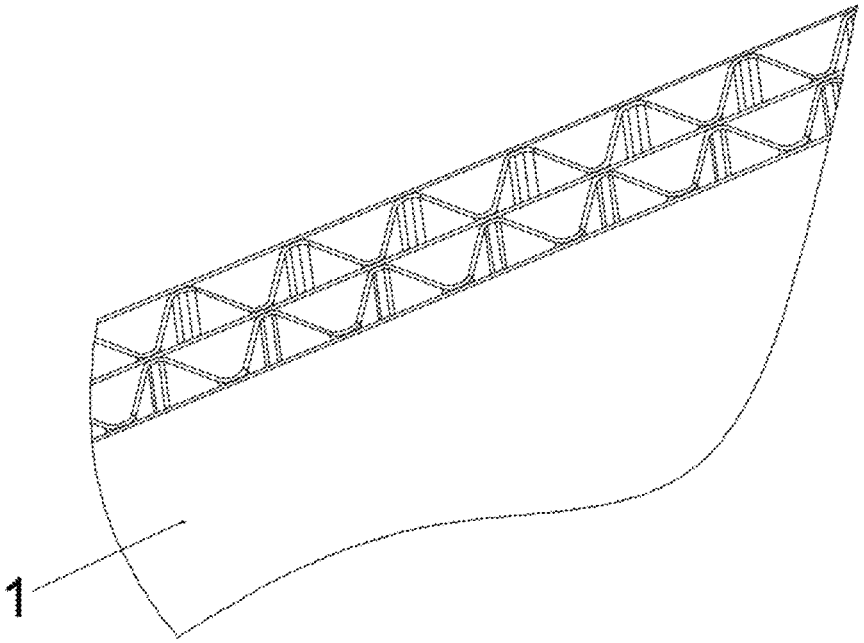
FIG. 5 is a schematic diagram of the double-layer corrugated board structure of the outer box body.

Referring to FIGS. 1 to 5, the present invention provides a packaging box for reduce volume and safe transportation for Storage ceramic generally includes Outer box body 1, A-type box body 2, B-type box body 3, packaged components 4, support bottom plate 5, Support column 6, first outer cover plate 7, second outer cover plate 8, first A-type cover plate 9, second A-type cover plate 10, first B-type cover plate 11, second B-type cover plate 12, B-type bottom plate 13, circular corrugated board 14, top ring body 15, The outer box body 1 is provided with an A-type box body 2 and a B-type box body 3 respectively. The outer box body 1, the A-type box body 2 and the B-type box body 3 are all folded from double-layer corrugated boards. The double-layer corrugated board structure can improve the compression resistance of the box body and ensure the transportation quality of the ceramic products. the outer box body 1 is symmetrically provided with a first outer cover plate 7 and a second outer cover plate 8, and the A-type box body 2 is symmetrically provided with a first A-type cover plate 9 and a second A-type cover plate 10. The B-type box body 3 is symmetrically provided with a first B-type cover plate 11 and second B-type cover plate 12. The B-type box body 3 and the A-type box body 2 are closely attached to each other, and the B-type box body 3 and the A-type box body 2 are both attached to the inner wall of the outer box body 1. The B-type box body 3 is provided with a B-type bottom plate 13 inside, and a circular corrugated board 14 is placed on the B-type bottom plate 13. The circular corrugated board 14 is attached to the inner wall of the B-type box body 3. After packaging, the outer box body 1 limits the A-type box body 2 and the B-type box body 3 to prevent the A-type box body 2 and the B-type box body 3 from shaking during transportation and causing damage to the internal products;

The first outer bottom plate 41 of the packaging component 4 is adhered to the first outer cover plate 7. The packaging component 4 consists of the first outer bottom plate 41, the second outer bottom plate 42, the external side connecting parts 43, the first external connecting piece 44, the second external connecting piece 45, the first A bottom plate 46, the second A bottom plate 47, the A-type side connecting parts 48, the first A connecting piece 49, the second A connecting piece 50, the first B bottom plate 51, the second B bottom plate 52, the B-type side connecting parts 53, the first B connecting piece 54 and the second B connecting piece 55. The first outer bottom plate 41 and the second outer bottom plate 42 are connected by Velcro. The second outer bottom plate 42 is fixed on the second outer cover plate 8, and the first outer bottom plate 41 and the second outer bottom plate 42 are symmetrically provided with a first external connecting piece 44 and a second external connecting piece 45 on both sides thereof, and the first external connecting piece 44 and the second external connecting piece 45 are both adhered to the external side connecting parts 43 by Velcro, and the external side connecting parts 43 is symmetrically fixed on both sides of the outer box body 1, and the first outer bottom plate 41 and the second outer bottom plate 42 adhered to each other by Velcro press the first outer cover plate 7 and the second outer cover plate 8 on the outer box body 1, so as to encapsulate the outer box body 1;

A-type side connecting parts 48 are symmetrically arranged on both sides of the A-type box body 2, and the first A-type connecting piece 49 and the second A-type connecting piece 50 are adhered to the A-type side connecting parts 48 by Velcro, and the first A-connecting piece 49 and the second A-connecting piece 50 are symmetrically arranged on both sides of the first A-type bottom plate 46 and the second A-bottom plate 47 respectively, and the first A-type bottom plate 46 and the second A-bottom plate 47 are fixed on the first A-type cover plate 9 and the second A-type cover plate 10 respectively, and the first A-type bottom plate 46 and the second A-type bottom plate 47 are adhered to each other by Velcro, and the first A-type bottom plate 46 and the second A-type bottom plate 47 adhered to each other by Velcro press the first A-type cover plate 9 and the second A-type cover plate 10 on the A-type box body 2, so as to encapsulate the A-type box body 2.

B-type side connecting parts 53 are symmetrically arranged on both sides of the B-type box body 3. The first B-type connecting piece 54 and the second B-type connecting piece 55 are adhered to the B-type side connecting parts 53 by Velcro. The first B-type connecting piece 54 and the second B-type connecting piece 55 are symmetrically arranged on the first B-type bottom plate 51 and the second B-type bottom plate 52 respectively. The first B-type bottom plate 51 and the second B-type bottom plate 52 are fixed on the first B-type cover plate 11 and the second B-type cover plate 12 respectively. The first B-type bottom plate 51 and the second B-type bottom plate 52 are adhered to each other by Velcro. The first B-type bottom plate 51 and the second B-type bottom plate 52 adhered to each other by Velcro press the first B-type cover plate 11 and the second B-type cover plate 12 onto the B-type box body 3, so as to encapsulate the B-type box body 3;

The support bottom plate 5 is provided at the inner bottom end of the A-type box body 2, and support columns 6 are sleeved in through holes uniformly provided on the support bottom plate 5, and the top ends of the support columns 6 are fixed on the side walls of the top ring body 15. The ceramic products in the A-type box body 2 are pressed tightly against the support bottom plate 5 by means of the support columns 6 and the top ring body 15 to prevent the products from shaking during transportation;

Specifically, the first using step in this invention is ceramic products to be transported are placed in the A-type box body 2 and the B-type box body 3 respectively, and the products in the B-type box body 3 are limited by the circular corrugated board 14, and then the support column 6 is sleeved on the support base plate 5, and the products in the A-type box body 2 are pressed tightly against the support base plate 5 through the top ring body 15, and then the first B-type cover plate 11 and the second B-type cover plate 12 on the B-type box body 3 are folded up, and the first B-type bottom plate 51 and the second B-type bottom plate 52 that are adhered to each other by Velcro are used to press the first B-type cover plate 11 and the second B-type cover plate 12 onto the B-type box body 3, and then the first B-type connecting piece 54 and the second B-type connecting piece 55 are adhered to the B-type side connecting parts 53 to complete the packaging process of the B-type box body 3; then the first A-type cover plate 9 and the second A-type cover plate 10 on the A-type box body 2 are folded up, and adhered to each other by Velcro The first A-type bottom plate 46 and the second A-type bottom plate 47 press the first A-type cover plate 9 and the second A-type cover plate 10 onto the A-type box body 2, and then adhere the first A-type connecting piece 49 and the second A-type connecting piece 50 to the A-type side connecting parts 48 to complete the packaging process of the A-type box body 2; finally, put the A-type box body 2 and the B-type box body 3 into the outer box body 1, and fold the first outer cover plate 7 and the second outer cover plate 8, and press the first outer cover plate 7 and the second outer cover plate 8 onto the outer box body 1 by the first outer bottom plate 41 and the second outer bottom plate 42 adhered to each other by Velcro, and then adhere the first outer connecting piece 44 and the second outer connecting piece 45 to the external side connecting parts 43 to complete the packaging process of the outer box body 1; there is no need to use tape for sealing, which avoids damage to the packaging during the disassembly process, so that the packaging box can be reused, thereby improving the practicality of the packaging.

Moreover, when using the ceramic packaging box, the B-type box body 2 can be filled with ceramic products of larger volume, such as ceramic dinner plates.

If there are dinner plates of different sizes, the traditional practice of stacking dinner plates of the same size and depth together can be abandoned. Instead, the structural characteristics of these dinner plates can be cleverly used to stack dinner plates of different sizes or depths in a staggered form, that is, a small-sized or small-depth dinner plate is stacked between large-sized or large-depth dinner plates. This method can make greater use of the space formed between the large-sized or large-depth dinner plates after they are stacked.

According to the above dinner plate stacking method, a larger number of dinner plates can be loaded in the B-type box body 2, achieving the effect of loading more dinner plates in the same size of space, that is, loading the same dinner plates, but reducing the volume of the packaging box.

It is known to those skilled in the art that the above-mentioned larger ceramic products are not limited to dinner plates, and the present ceramic packaging box is not limited to packaging dinner plates, but can also be other tableware or other ceramic products. Users can reasonably refer to the above method and use stacking methods of different sizes and depths to maximize the space of the B-type box body 2 and pack more ceramic products.

What is claimed is:

1. A packaging box, comprising:

an outer box body, a first box body, a second box body, a packaging component, a supporting bottom plate, a supporting column, a first outer cover plate, a second outer cover plate, a first cover plate, a second cover plate, a third cover plate, a fourth cover plate, a third bottom plate, a fourth bottom plate, a circular corrugated board, and a top ring body;

wherein the first box body and the second box body are respectively arranged inside the outer box body;

the outer box body, the first box body, and the second box body are all formed by folding a double-layer corrugated board;

the first outer cover plate and the second outer cover plate are symmetrically arranged on the outer box body, the first cover plate and the second cover plate are symmetrically arranged on the first box body, and the third cover plate and the fourth cover plate are symmetrically arranged on the second box body;

the second box body and the first box body are closely attached to each other, and the second box body and the first box body are both attached to an inner wall of the outer box body;

the third and fourth bottom plates are arranged inside the second box body, and the circular corrugated board is placed on the third and fourth bottom plates; and the circular corrugated board is attached to an inner wall of the second box body.

2. The packaging box of claim 1, wherein the first outer bottom plate of the packaged component is adhered to the first outer cover plate, and the packaged component is composed of the first outer bottom plate, the second outer bottom plate, external side connecting parts, a first external connecting piece, a second external connecting piece, a first bottom plate, a second bottom plate, first side connecting parts, a first connecting piece, a second connecting piece, a first third bottom plate, a fourth bottom plate, second side connecting parts, a third connecting piece, and a fourth connecting piece.

3. The packaging box of claim 2, wherein the first outer bottom plate and the second outer bottom plate are connected by Velcro, the second outer bottom plate is fixed on the second outer cover plate, the first outer bottom plate and the second outer bottom plate are symmetrically provided with the first external connecting piece and the second external connecting piece on both sides, the first external connecting piece and the second external connecting piece are both adhered to the external side connecting parts by Velcro, and the external side connecting parts are symmetrically fixed on both sides of the outer box body.

4. The packaging box of claim 1, wherein first side connecting parts are symmetrically arranged on both sides of the first box body, a first connecting piece and a third connecting piece are adhered to the first side connecting parts by Velcro, the first connecting piece and the third connecting piece are symmetrically arranged on both sides of the first bottom plate and the second bottom plate, respectively, the first bottom plate and the second bottom plate are respectively fixed on the first cover plate and the second cover plate, and the first bottom plate and the second bottom plate are adhered to each other by Velcro.

5. The packaging box of claim 1, wherein the B-type-second box body is symmetrically provided with second side connecting parts, and the second side connecting parts are adhered with a third connecting piece and a fourth connecting piece by Velcro.

6. The packaging box of claim 5, wherein the third connecting piece and the fourth connecting piece are symmetrically arranged on the third bottom plate and the fourth bottom plate, respectively, the third bottom plate and the fourth bottom plate are fixed on the third cover plate and the fourth cover plate, respectively, and the third bottom plate and the fourth bottom plate are mutually adhered by Velcro.

7. The packaging box of claim 1, wherein the supporting bottom plate is provided at an inner bottom end of the first box body, supporting columns are sleeved in through holes evenly provided on the supporting bottom plate, and top ends of the supporting columns are fixed on side walls of the top ring body.

* * * * *